United States Patent [19]

Rumpel

[11] Patent Number: 4,564,184

[45] Date of Patent: Jan. 14, 1986

[54] PASTING STATION FOR A FAST PRINTER

[75] Inventor: Peter Rumpel, Feldkirchen-Westerham, Fed. Rep. of Germany

[73] Assignee: Siemens Aktiengesellschaft, Berlin and Munich, Fed. Rep. of Germany

[21] Appl. No.: 631,079

[22] Filed: Jul. 16, 1984

[30] Foreign Application Priority Data

Aug. 4, 1983 [DE] Fed. Rep. of Germany ..... 3328255

[51] Int. Cl.[4] ..... B41L 1/32

[52] U.S. Cl. ..... 270/39; 156/502; 156/507

[58] Field of Search ..... 270/39; 271/4–5, 271/10, 18, 109, 112, 119; 156/502, 504–509, 157; 283/62; 226/91–92

[56] References Cited

U.S. PATENT DOCUMENTS

| | | | |
|---|---|---|---|
| 1,572,439 | 2/1926 | Bombard et al. | 271/119 |
| 2,844,186 | 7/1958 | Sunnen, Jr. | 156/507 |
| 3,169,896 | 2/1965 | Dresser | 156/507 |
| 3,937,452 | 2/1976 | Gath | 270/39 |
| 3,998,449 | 12/1976 | Hornung | 271/119 |
| 4,127,261 | 11/1978 | Meratti | 270/55 |
| 4,192,497 | 3/1980 | Perun et al. | 271/18 |
| 4,239,582 | 12/1980 | McGrath . | |
| 4,252,597 | 2/1981 | Monroe . | |
| 4,289,556 | 9/1981 | Booth . | |
| 4,328,066 | 5/1982 | Kiuchi et al. | 156/506 |
| 4,334,946 | 6/1982 | Kanoto | 156/507 |
| 4,417,942 | 11/1983 | Kincheloe | 156/502 |
| 4,427,590 | 12/1983 | Meschi | 156/506 |
| 4,455,189 | 6/1984 | Takasuga | 156/502 |
| 4,470,587 | 9/1984 | Coon, Jr. | 270/55 |

FOREIGN PATENT DOCUMENTS

| | | | |
|---|---|---|---|
| 0042619 | 12/1981 | European Pat. Off. . | |
| 59981 | 9/1982 | European Pat. Off. | 156/502 |
| 1761518 | 7/1971 | Fed. Rep. of Germany . | |
| 1122567 | 8/1968 | United Kingdom . | |

OTHER PUBLICATIONS

"Carton-to-Carton Continuous Forms Card Splicing", IBM Technical Disclosure Bulletin, vol. 13, No. 1, Jun. 1970, pp. 90–91.

*Primary Examiner*—E. H. Eickholt

*Attorney, Agent, or Firm*—Hill, Van Santen, Steadman & Simpson

[57] ABSTRACT

An apparatus with an arrangement for connecting individual fanfolded stacks of prefolded continuous form paper to produce a continuous web to feed to a fast printer characterized by a longitudinally extending transfer plane or table comprising a work region which is adjacent the printer and a supply region spaced from the work region by a transversely extending gap which receives the free edge of the bottom sheet of a stack as the stack is moved across the gap from the supply region to the work region. After movement into the working region, the bottom sheet is in a trailing exposed position that enables connecting to the top sheet of the next following stack by the connecting arrangement.

16 Claims, 8 Drawing Figures

PASTING STATION FOR A FAST PRINTER

BACKGROUND OF THE INVENTION

The present invention is directed to an apparatus with a pasting or connecting arrangement for connecting individual fan folded stacks of prefolded continuous form paper for producing a continuous paper web in a paper feed of a fast printer.

It is generally standard and known that in fast printers such as laser printers which have a high printing rate, to provide a connecting or pasting station in the paper feed which is in front of the actual printer. In order to reduce the down times, the pasting station makes it possible to glue the fanfolded stacks of paper, which stacks are supplied in individual stacks weighing about 15 kilograms, to one another so that a continuous paper feed occurs for the printer. To this end, the end or lowest sheet in the first stack and the beginning or top sheet of the second stack are glued to one another in a downstream pasting station.

In a known pasting station, which is provided in a data media processing system referred to as a DMP manufactured by Meschi Company of Italy, fanfolded stacks are especially designed to enable the last sheet in the first stack to be connected to the top sheet of the second following stack. To accomplish this, the specially designed stacks have the last bottom layers of the fanfolded stack disposed in the package to be laterally folded upward alongside the edge of the stack. When the package is opened, the last sheet of the fanfolded stack is thus freely accessible and can be easily removed and glued or secured to the top sheet of the next following fanfolded stack. However, fanfolded stacks, which are produced in this manner, are expensive and tie the use of the system to an individual manufacturer.

SUMMARY OF THE INVENTION

The present invention is to provide a pasting or connecting station which enables connecting the last sheet of a fanfolded stack to the top sheet of the next following stack to form a continuous web of paper for a fast printer. The device of the present invention enables producing this without requiring the lifting of the stack in order to obtain access to the bottom sheet.

To accomplish these goals, the present invention is directed to an improvement in an apparatus with means for connecting individual fanfolded stacks of prefolded continuous form paper for producing a continuous web to feed a fast printer, the improvement comprising a longitudinally extending transfer plane comprising a work region which is adjacent the printer and a supply region spaced from the work region by means for forming a turning gap extending transverse to the longitudinal direction of the transfer plane, said means for forming a turning gap receiving a bottom sheet of a fanfolded stack as the stack is moved in the longitudinal direction from the supply region across the gap to the work region and exposing the last sheet for connecting to a top sheet of the next following stack by the means for connection.

While in the broadest sense, the leading edge of the last sheet can be pushed into the turning gap as the stack is moved across the gap, gripping or seizing means are preferably provided at the gap which may be either a suction means or a roller having a sticky surface which will grasp or seize the free edge of the bottom sheet and pull it down as the stack is moved across the gap. The means for connecting may be mounted for pivotal movement from a position withdrawn from the gap to a position inserted in the gap to allow joining of the two sheets after the exposing of the bottom sheet of the stack passing over the gap. It is also possible for the connecting means to be located in a position other than the turning gap such as in a separate pasting gap. The transfer plane has a surface which is designed to promote the easy movement of a stack along the longitudinal direction. This can be accomplished by having a surface formed by a corrugated sheet with the grooves and ridges extending in the longitudinal direction or by a plurality of individual conveyor belts moving over a surface. If conveyor belts are used, a set is used to convey the stack up to the gap and a second set is used to convey the stack after it is transferred to the work region.

The means for connecting will have a support surface, which is provided with a cutting element for adhesive tape and also adjustable aligning pins which engage and hold the edge of the sheets of the fanfolded stack. The adhesive tape can be on a roll movable on a guide means which is pivotal into a position above the seam between the two sheets to be joined or the tape may be on a reel which is adjacent one edge and the tape is pulled across the sheets that are to be joined. The guided pins can be adjustably positioned at least on one side to allow handling webs of differnt widths.

The apparatus of the present invention may also be provided with a centering arrangement or means at an end of the work region adjacent the printer. The centering means can be a frame, which pivots around a roller on which the web is passed around. The frame is movable to a horizontal position to cover the paper web as it extends to the intake of the printer and has guide pins for engagement in guide holes of the printer.

The fanfolded stacks can be easily secured to one another without being lifted up due to the inventive arrangement of the longitudinally extending transfer plane or table which has a supply region and a work region which are separated by a gap formed by the means for forming a gap. When a fanfolded stack lies in the supply region and is displaced across the gap of the means forming a gap, the front edge or leading edge of the bottom sheet can be pulled into the gap so that as the stack completes its movement across the gap into the work arrangement, the bottom sheet will lie freely accessible and trail behind the stack. Thus, the top sheet of the next following stack can be easily brought into position for being connected such as by the connecting means to the bottom sheet of the earlier-mentioned stack.

Figure 3:
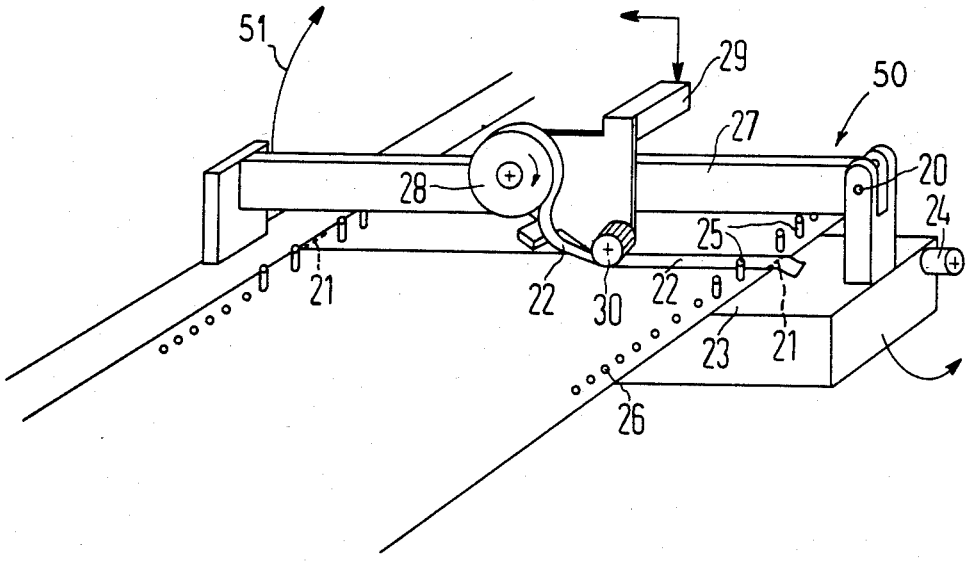
Figure 4:
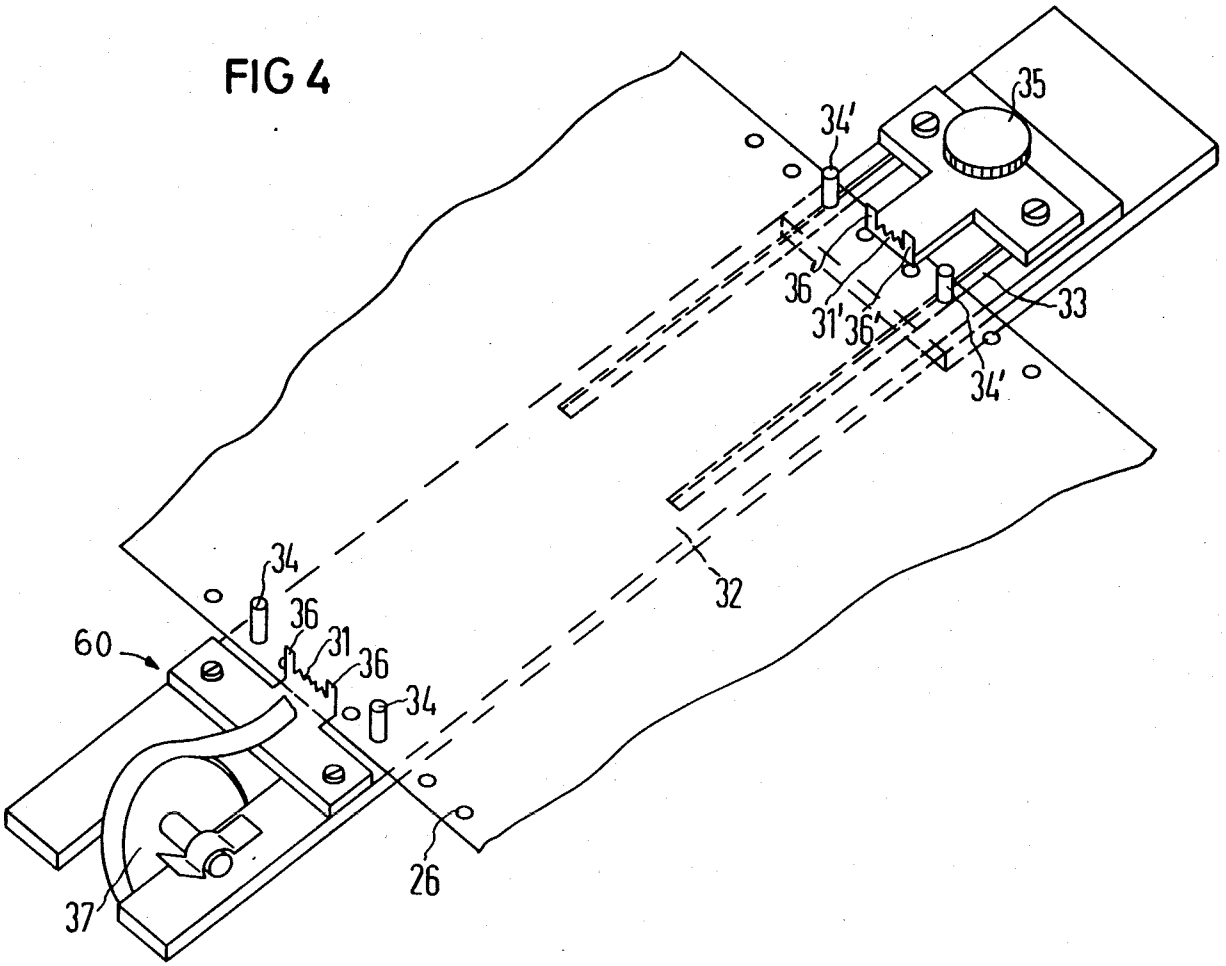

FIGS. *2a–2e* are schematic illustrations showing the various steps of exposing the bottom sheet with FIG. *2a* illustrating the depressing of the leading edge of the bottom sheet into the gap; FIG. *2b* showing the beginning of movement of the stack across the gap; FIG. *2c* showing almost the completion of the movement of the stack across the gap; FIG. *2d* showing completion of the movement across the gap; and FIG. *2e* showing the joining of the bottom sheet trailing from the stack with the top sheet of the next succeeding stack;

FIG. 3 is a perspective illustration of an embodiment of the connecting station with a pivotal adhesive tape guide; and FIG. 4 is a perspective illustration of an embodiment of the connecting station having two centering pins.

DESCRIPTION OF THE PREFERRED EMBODIMENTS

The principles of the present invention are particularly useful when incorporated in an apparatus generally indicated at 40 for connecting individual fanfolded stacks of prefolded continuous form paper to provide a continuous web 41 to feed to a fast printer 1 which may be a laser printer. A fanfolded stack is a stack of sheets formed by folding the web into a Z shape with a fold line defining a trailing edge of one sheet connected to a leading edge of the next following sheet.

Figure 1:
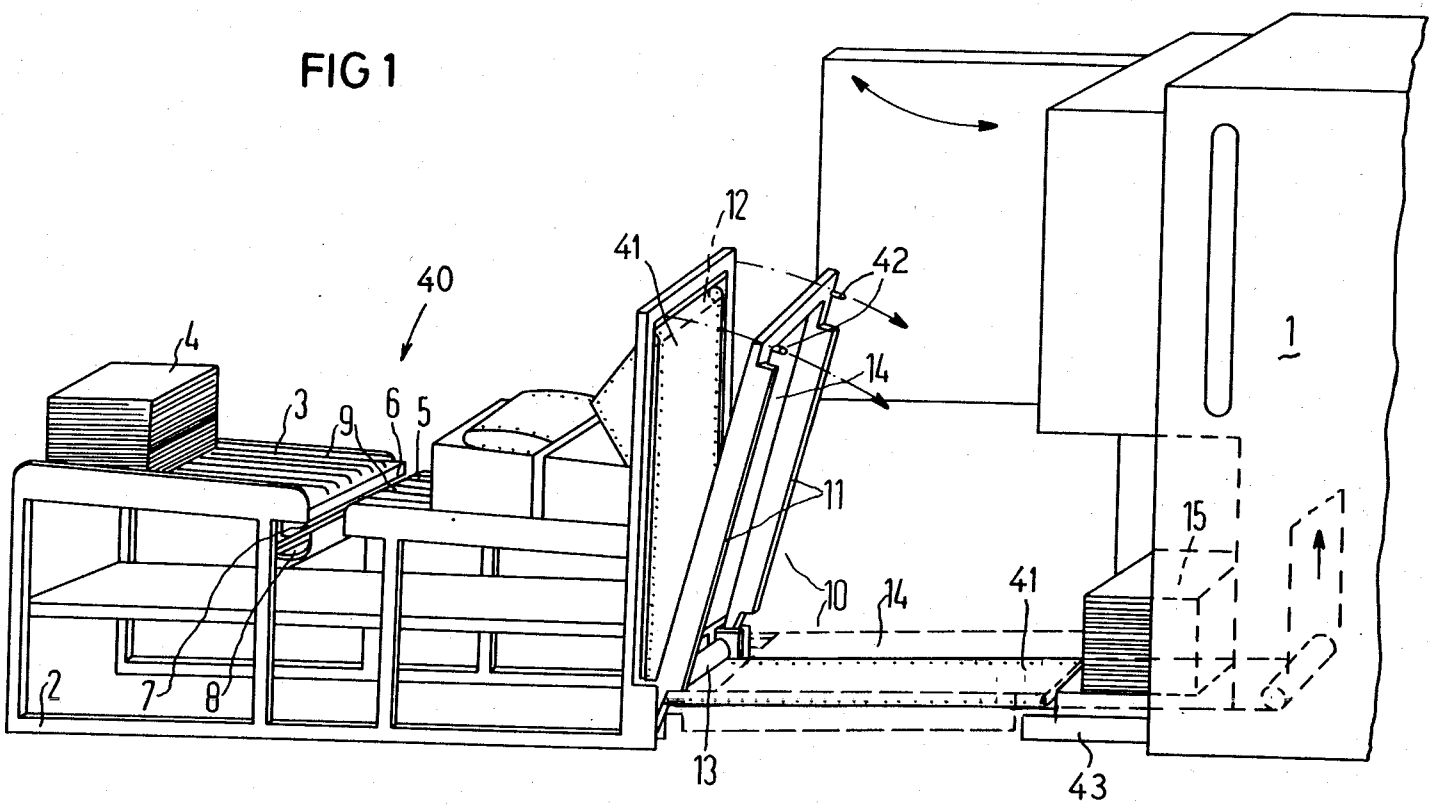
FIG. 1 is a perspective view of the apparatus with pasting means in accordance with the present invention utilized with a printer.
Figure 2A:
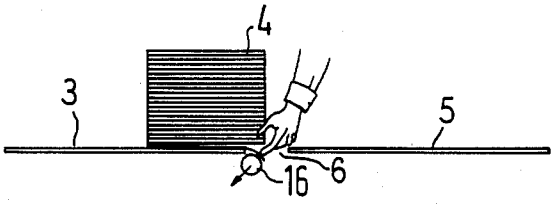
Figure 2B:
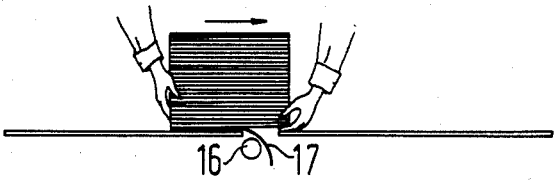
Figure 2C:
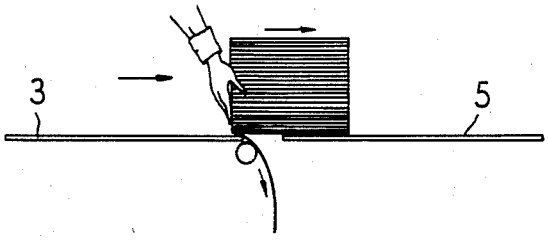
Figure 2D:
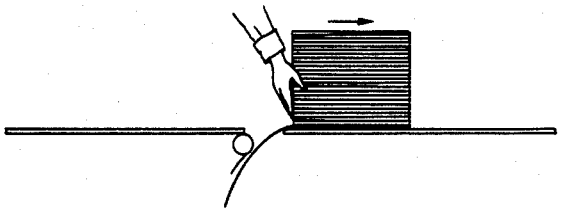
Figure 2E:
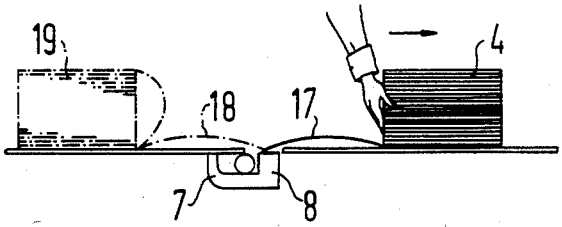

The apparatus 40 has a frame 2, which supports a transfer plane or table which is illustrated as formed by a supply region 3 for the acceptance of a fanfolded stack 4 of prefolded continuous paper which is supplied in packages. The transfer plane or table also includes a work region 5, which is adjacent the printer and from which a paper web 41 of the fanfolded stack 4 which has been interconnected to another stack is supplied to the printer 1. Between the two regions or table portions 4 and 5 is means for forming a turning or reversing gap 6 which extends transverse to the longitudinal direction of the transfer plane in the direction of movement of the stacks thereon. The apparatus 40 also includes joining means 8 for connecting two stacks together, which means 8 can be pivoted around a pivot axis 7 from a withdrawn position as illustrated in FIG. 1 to a second position in the gap 6 which is best illustrated in FIG. *2e*. In order to facilitate movement of the stacks along the table portions of the transfer plane, the upper surfaces are provided with sliding surfaces both in the supply region 3 as well as in the work region 5. As illustrated in FIG. 1, the sliding surface comprises longitudinally extending ridges 9 which are formed in a corrugated sheet which forms the upper surface of each of the tables. With the ridges 9 in the corrugated sheet, one's finger can slide into the depression of the corrugated sheet between ridges 9 when putting the fanfolded stack 4 in place or, respectively, when shifting it. Instead of utilizing corrugated sheets with ridges 9, it is possible to use a sliding surface which is formed by a plurality of conveyor belts which would extend in the londitudinal direction with one set of belts being arranged for the table of the supply region 3 and a second group being used with the work region 5. With the two groups, the gap 6 would be free of belts.

In order to facilitate centering the device or apparatus 40 at the laser printer 1, the work region 5 is followed by a centering means 10 which can be pivoted from a vertical upstanding position down to a horizontal position which is shown in phantom lines. The centering means 10 comprises a pair of side elements 11 and a cover surface 14. Adjacent the free end, centering means 10 has pins or projections 42 which can be engaged in holes in a paper guide region 43 of the laser printer 1 when the means 10 is placed in the horizontal down position. When in the horizontal position, the lateral side edges or faces 11 as well as the cover sheet 14 form a protective box for the paper web 41 which serves both as a kick plate for the running paper web and also facilitates the removal of a paper stack 15 which has been discharged from the printer 1. It should be noted that the pivotal movement of the centering means 10 is around an axis of the roller 13, which roller coacts with the roller 12 to guide the paper or web 41 into the printer 1.

The function and operation of the device is best explained with reference to FIGS. *2a–2e*. Prefolded continuous form paper is supplied in a fanfolded stack 4 on the supply region 3 of the apparatus 40. The weight of the stack 4 is roughly 15 kilograms and the entire weight rests entirely on the bottom sheet which complicates the ability of obtaining access to this bottom sheet. In order then to be able to have easy access and form a connection of the bottom sheet of the fanfolded stack 4 to the top sheet of the following fanfolded stack, the unpacked fanfolded stacks are placed on the supply region 3 of the apparatus 40 so that the free end or edge of the bottom sheet points toward the gap 6. In accordance with the illustration of FIG. *2a*, the bottom sheet can be grasped by the hand in the region of its free end and pressed down when the stack 4 has been displaced so that the leading edge of the stack is over the gap 6. This downward pressing of the sheet of the stack is only necessary when, unlike in the schematic illustration of FIG. *2a*, a grasping means is not provided. As illustrated in FIG. *2a*, a grasping means in the form of a drum 16 which can either have a suction arrangement or a sticky surface is provided at the gap 6 and will seize or grasp the bottom sheet when the fanfolded stack 4 is moved across the gap and cause the bottom sheet to be drawn into the gap as illustrated in FIGS. *2b*, *2c* and *2d*. After the stack 4 has been completely moved across the gap 6 onto the work region 5 in accordance with the illustration of FIG. *2d*, the bottom sheet 17 of the stack is pivoted by the gap 6 into a following or trailing position such as illustrated in FIG. *2e* and into a position where it can be joined to the top sheet 18 of the next following fanfolded stack 19. The joining means 8 is then pivoted into the gap 6 and the two sheets are connected to one another with the desired fit with the assistance of adhesive tape.

As mentioned, instead of utilizing a drum 16 with a sticky surface shown in FIGS. *2a–e*, it is also known to provide notoriously known suction means in order to generate at a slight underpressure so that the bottom sheet of the stack can be drawn into the gap 6 in a manner analogous to known sheet lifting means in sheet separators.

The joining means 8 for connecting the individual sheets of the fanfolded stacks can have various designs. In FIG. 3, a joining means generally indicated at 50 is illustrated and has a support member 23 with a surface which is provided with spaced-apart cutting elements 21 for cutting an adhesive tape such as 22. The support member 23 is displaceable toward the left or right by means of an adjustment screw 24. Adjustment pins 25 will engage margin perforations 26 of the individual sheets of the fanfold stack 4 which sheets are to be connected and thus suggest the position of the sheets on the surface 23. Given the embodiment according to FIG. 3, the adjustment means, which are not shown in detail, are provided to enable the distance between the adjustment pins 25 to be set to accommodate different widths of the web which will occur with various continuous form papers. Such an adjustment means can consist, for example, of providing either the left or right adjustment pins on a carriage so that it can be laterally displaced on the surface of the member 23.

In order to secure the two single sheets hooked on the adjustment pins, the guide means 27 for an adhesive tape 22 is pivoted over the seam of the single sheets. The guide means 27 is connected to the support member 23 by a pivot joint 20 so that it can be pivoted between the illustrated position to a withdrawn position. With the guide means 27 in place, the adhesive tape is then applied by a rubber pressure roller 30 to the individual sheets by sliding a handle 29 on the guide 27 to move across the sheets. As illustrated, this movement will cause the tape to be drawn from a supply roll 28 and pressed onto the two edges to be connected. The cutter blades 21 serve as lateral limitations and cut the adhesive tape off when the pressure roller moves thereover.

After the taping, the guide means 27 is then pivoted away in the direction of arrow 51 and the overall means 50 is again pivoted out of the gap 6.

A simplified embodiment of the joining or taping means is generally indicated at 60 in FIG. 4. The embodiment 60 includes a support member 32, which at one end is provided with a mount for mounting a supply roll 37 of adhesive tape. Adjacent the roll 37 a surface of the member 32 is provided with a tear-off edge 31 which has lateral guides 36,36. Also adjacent the supply roll 37 the support member 32 has fixedly mounted adjustment pins 34 for the acceptance of margin perforations 26 of the web of the fanfolded stack. On the opposite end of the support member, a guidance carrier 33 supports adjustment pins 34',34' as well as a cutting edge 31' which has the lateral guides 36'. The carriage 33 can be locked in the desired adjustable position by means of a set screw such as 35. Thus, the carriage 33 can be moved to compensate for changes in the web of the stacks being handled.

In order to connect the two fanfolded stacks, the bottom and the top sheets of the fanfolded stacks are hooked onto the adjustment pins 34 and 34' and the adhesive tape is taken from the supply roll 37 and guided through the centering arrangement provided by the lateral guide pins 36. After the desired length of tape has been reached, the tear-off edges 31 are utilized to cut the tape to length.

Although various minor modifications may be suggested by those versed in the art, it should be understood that I wish to embody within the scope of the patent granted hereon, all such modifications as reasonably and properly come within the scope of my contribution to the art.

I claim:

1. In an apparatus with joining means for connecting individual respective bottom and top sheets of successive fanfolded stacks of prefolded continuous form paper at a seam to provide a continuous web to feed to a fast printer, the improvements comprising a longitudinally extending transfer plane comprising a work region which is adjacent the printer and a supply region spaced from the work region by means for forming a turning gap extending transverse to the longitudinal direction of the transfer plane, said means for forming a turning gap receiving a leading edge of a bottom sheet of a fanfolded stack as the stack is moved on said transfer plane in the longitudinal direction from the supply region to the work region and directing said leading edge to said joining means and thereby exposing said bottom sheet for connection by said joining means at said seam to a top sheet of the next following stack.

2. An apparatus according to claim 1 further comprising means for seizing the bottom sheet of the fanfolded stack being disposed at the means for forming the gap to aid in drawing the bottom sheet into the gap.

3. An apparatus according to claim 2, wherein the means for seizing include suction means.

4. An apparatus according to claim 2, wherein the means for seizing include a roller having a sticky surface.

5. An apparatus according to claim 1, further comprising means for pivotably mounting the joining means for movement between a position withdrawn from the gap to a position disposed in said gap.

6. An apparatus according to claim 1, wherein the joining means is positioned in the work region and disposed in a separate gap.

7. An apparatus according to claim 1, wherein the transfer plane is formed by a pair of surfaces having means for facilitating moving a stack in the longitudinal direction.

8. An apparatus according to claim 7, wherein said means for facilitating movement comprises a corrugated sheet having upstanding ribs extending in the longitudinal direction with depressions disposed therebetween.

9. An apparatus according to claim 7, wherein the means for facilitating movement comprises a plurality of conveyor belts disposed one beside the other and extending in the longitudinal direction.

10. An apparatus according to claim 9, wherein the conveyor belts are arranged in two groups with one group for the supply region and a second group with the work region and the gap being free of any belts.

11. An apparatus according to claim 1, wherein the joining means include a support member with a surface supporting a cutting element for adhesive tape and having adjustment pins for acceptance of the margin perforation of the sheets of the fanfolded stack which are to be connected, said pins being adjustably disposed to enable compensation for different widths in the sheets, said means for connecting including guide means being pivotably mounted to extend over a seam between the sheets to be connected and an adhesive tape storage reel mounted for sliding movement on said guide means to enable movement across the seam.

12. An apparatus according to claim 1, wherein the joining means include a support member with a surface supporting a roll of adhesive tape at one end and provided with a tear-off edge at said one end along with adjustment pins for acceptance in the marginal perforations on one side of the sheets to be joined together, a carriage having adjustment pins and a tape cutoff edge being adjustably mounted on the opposite end of the support surface so that compensation for different widths can be obtained.

13. An apparatus accordng to claim 1, further comprising centering means for obtaining correct alignment of the apparatus relative to a receiving selction of a printer.

14. An apparatus according to claim 13, wherein said centering means include a pivotable frame hinged to the work station, said pivotable frame having a cover and movable from a vertically extending position to a horizontal position with guide pins received in sockets in the receiving section of the printer.

15. An apparatus for joining respective bottom and top sheets of successive stacks of fanfolded sheets to form a continuous web comprising:

a table having a co-planar supply region and work region disposed in succession, said table having a gap disposed between said supply and work regions and a first of said successive stacks of fanfold sheets being initially disposed on said supply region;

means for directing a bottom sheet of said first stack into said gap as said first stack is slid on said table over said gap from said supply region to said work region such that said bottom sheet trails said first stack when said first stack reaches said work station; and means movable into said gap for connecting a trailing edge of said bottom sheet to a leading edge of a top sheet of a next successive fanfolded stack in said gap.

16. A method for connecting a bottom sheet of a first stack of fanfolded sheets to a top sheet of a following second stack of fanfolded sheets comprising the steps of:

sliding said first stack along a planar table having a gap therein over said gap;

directing said bottom sheet of said first stack into said gap;

continuing sliding of said first stack on said table past said gap such that said bottom sheet is withdrawn from said gap trailing said first stack;

removing said top sheet from said second stack and positioning said leading edge of said top sheet adjacent said trailing edge of said bottom sheet of said first stack in said gap; and connecting said leading and trailing edges in said gap by moving an adhesive tape-applying means across said gap for dispensing and adhering tape to said leading and trailing edges.

* * * * *